US007806478B1

(12) United States Patent
Cvek

(10) Patent No.: US 7,806,478 B1
(45) Date of Patent: Oct. 5, 2010

(54) TASK CHAIR WITH DUAL TILTING CAPABILITIES

(76) Inventor: Sava Cvek, 40 Woodland Rd., Jamaica Plain, MA (US) 02130

( * ) Notice: Subject to any disclaimer, the term of this patent is extended or adjusted under 35 U.S.C. 154(b) by 92 days.

(21) Appl. No.: 11/620,043

(22) Filed: Jan. 4, 2007

Related U.S. Application Data

(60) Provisional application No. 60/756,331, filed on Jan. 4, 2006.

(51) Int. Cl.
*A47C 1/024* (2006.01)

(52) U.S. Cl. ..... 297/300.1; 297/303.1; 297/302.1; 297/313

(58) Field of Classification Search ..... 297/300.1, 297/300.2, 300.3, 300.4, 300.5, 313, 316, 297/340, 344.1, 344.15, 302.1, 303.1
See application file for complete search history.

(56) References Cited

U.S. PATENT DOCUMENTS

| | | | | | |
|---|---|---|---|---|---|
| 233,140 | A | | 10/1880 | Candrian | |
| 2,558,171 | A | | 6/1951 | Chesley | |
| 2,615,496 | A | * | 10/1952 | Lorenz et al. | 297/83 |
| 2,818,911 | A | * | 1/1958 | Syak | 248/575 |
| 3,369,840 | A | * | 2/1968 | Dufton | 297/300.1 |
| 3,740,792 | A | * | 6/1973 | Werner | 16/298 |
| 4,157,203 | A | | 6/1979 | Ambasz | |
| 4,709,962 | A | | 12/1987 | Steinmann | |
| 4,718,716 | A | | 1/1988 | Stumpf et al. | |
| 4,761,033 | A | | 8/1988 | Lanuzzi et al. | |
| 4,834,453 | A | | 5/1989 | Makiol | |
| 4,848,841 | A | * | 7/1989 | Giselsson | 297/423.13 |
| 4,854,641 | A | * | 8/1989 | Reineman et al. | 297/344.15 |
| 4,880,272 | A | | 11/1989 | Brauning | |
| 5,071,189 | A | * | 12/1991 | Kratz | 297/300.1 |
| 5,080,318 | A | * | 1/1992 | Takamatsu et al. | 248/598 |
| 5,080,435 | A | * | 1/1992 | Desanta | 297/316 |
| 5,249,839 | A | | 10/1993 | Faiks et al. | |
| 5,261,727 | A | * | 11/1993 | Klaebel | 297/423.13 |
| 5,338,094 | A | | 8/1994 | Perry | |
| 5,356,199 | A | * | 10/1994 | Elzenbeck et al. | 297/313 |
| 5,383,712 | A | | 1/1995 | Perry | |
| 5,772,282 | A | | 6/1998 | Stumpf et al. | |
| 6,386,634 | B1 | | 5/2002 | Stumpf et al. | |
| 6,431,649 | B1 | * | 8/2002 | Hensel | 297/300.2 |
| 6,709,058 | B1 | | 3/2004 | Diffrient | |
| 6,959,965 | B2 | | 11/2005 | Diffrient | |
| 6,966,604 | B2 | | 11/2005 | Stumpf et al. | |
| 2003/0184140 | A1 | * | 10/2003 | Bruske | 297/316 |
| 2004/0026973 | A1 | * | 2/2004 | Sander et al. | 297/316 |
| 2005/0275265 | A1 | * | 12/2005 | Deimen et al. | 297/316 |

* cited by examiner

*Primary Examiner*—Sarah B McPartlin
(74) *Attorney, Agent, or Firm*—O'Connell Law Firm

(57) ABSTRACT

A task chair capable of forward and rearward synchronized movement with a base assembly, a linkage supported by the base assembly to pivot about an axis in relation to the base assembly, a seat assembly pivotally retained relative to the linkage, and a back assembly pivotally retained relative to the linkage. The linkage can include a bracket and a resiliently deflectable assembly retained relative to the bracket. A projection retained by the base assembly can engage the resiliently deflectable assembly whereby the linkage and the seat and back assemblies can pivot in relation to the base assembly. The linkage can have a bracket; a first link pivotally coupled at a first axis relative to the bracket, pivotally coupled at a second pivot axis relative to the seat assembly, pivotally coupled at a third pivot axis relative to the back assembly; and a second link pivotally coupled at a first axis relative to the bracket and at a second axis relative to the back assembly.

12 Claims, 17 Drawing Sheets

TASK CHAIR WITH DUAL TILTING CAPABILITIES

PRIORITY CLAIM

This application claims the benefit of application Ser. No. 60/756,331, filed on Jan. 4, 2006, which is incorporated herein by reference.

FIELD OF THE INVENTION

This invention relates generally to chairs. More particularly, disclosed and protected herein is a kinematic, synchronized, multi-pivot forward and backward tilting task chair for enabling a seamless transition between tasks requiring use of a work surface and tasks wherein a user would tend to be disposed in a reclined position.

BACKGROUND OF THE INVENTION

During a typical workday, depending on the task being performed, a seated person will tend to seek to sit upright, to lean forward, to lean backward, and to lean to the side. Therefore, it would be desirable to have a chair capable of providing complete and proper ergonomic support while the chair is moved through positions that correspond to various tasks that a sitting person might be called upon to perform. It would be similarly desirable to provide a chair that can be readily raised or lowered for height adjustment.

Still further, since people of the same height will vary in, for instance, the length of the upper legbone from the hip to the knee, it would be desirable to have a chair capable of accommodating such variations. It will be further appreciated that a chair providing ergonomic support must accommodate not only different lengths of the upper leg, it must also be responsive to the changing curvature of the spine as a person leans forward or backward. For example, when a person leans backward, the lumbar portion of the spine moves forward relative to the rest of the spine. Accommodating such changes would enhance the comfort, posture, and, potentially, the physiological health of the user.

SUMMARY OF THE INVENTION

Advantageously, the present invention seeks to provide a chair that achieves each of the foregoing and still further objects. Embodiments of the chair disclosed herein include a seat and lumbar supporting portion and an upper back supporting portion. The lumbar supporting portion is connected to the upper back supporting portion by a linkage which is operative to pivot the lumbar supporting portion and the seat downward around the front edge of the seat when the upper back supporting portion is moved back, as when a person sitting in the chair leans back whereby the lower back supporting portion continues to support the lower back while the upper back supporting portion supports the upper hack.

DETAILED DESCRIPTION OF PREFERRED EMBODIMENTS

Numerous objects and advantages of the present invention will become obvious not only to one who reviews the present specification and drawings but also to those who experience an embodiment of the present invention in operation. However, it will be appreciated that, although the accomplishment of each of multiple objects in a single embodiment of the invention may be possible and indeed preferred, not all embodiments will seek or need to accomplish each and every potential advantage. Nonetheless, all such embodiments should be considered within the scope of the present invention.

As is the case with many inventions, the present invention for a dual tilting task chair is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction and illustrations of inventive concepts are mere examples of the many possible manifestations of the invention.

Figure 1:
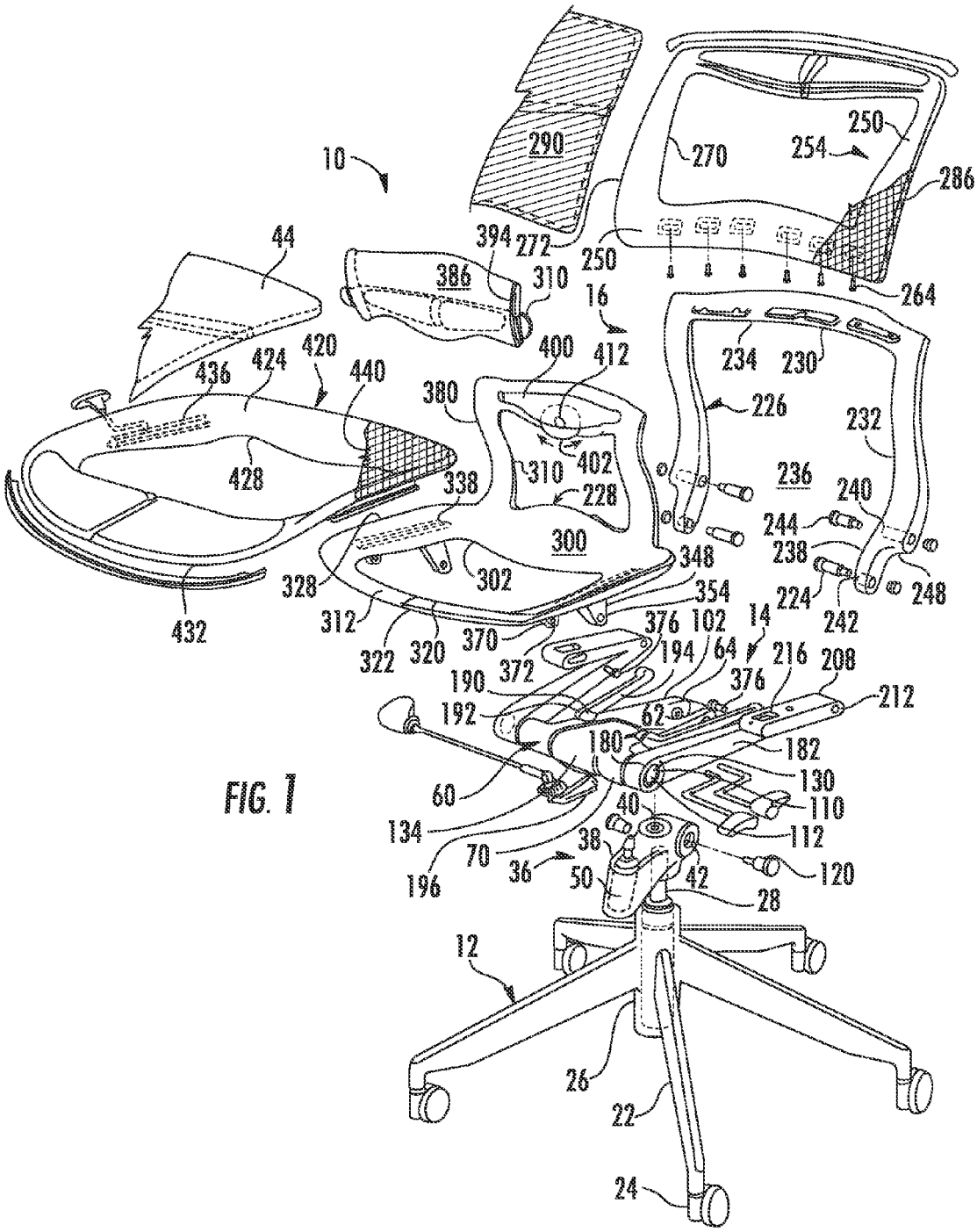
FIG. 1 is an exploded perspective view of a task chair pursuant to the present invention.
Figure 2:
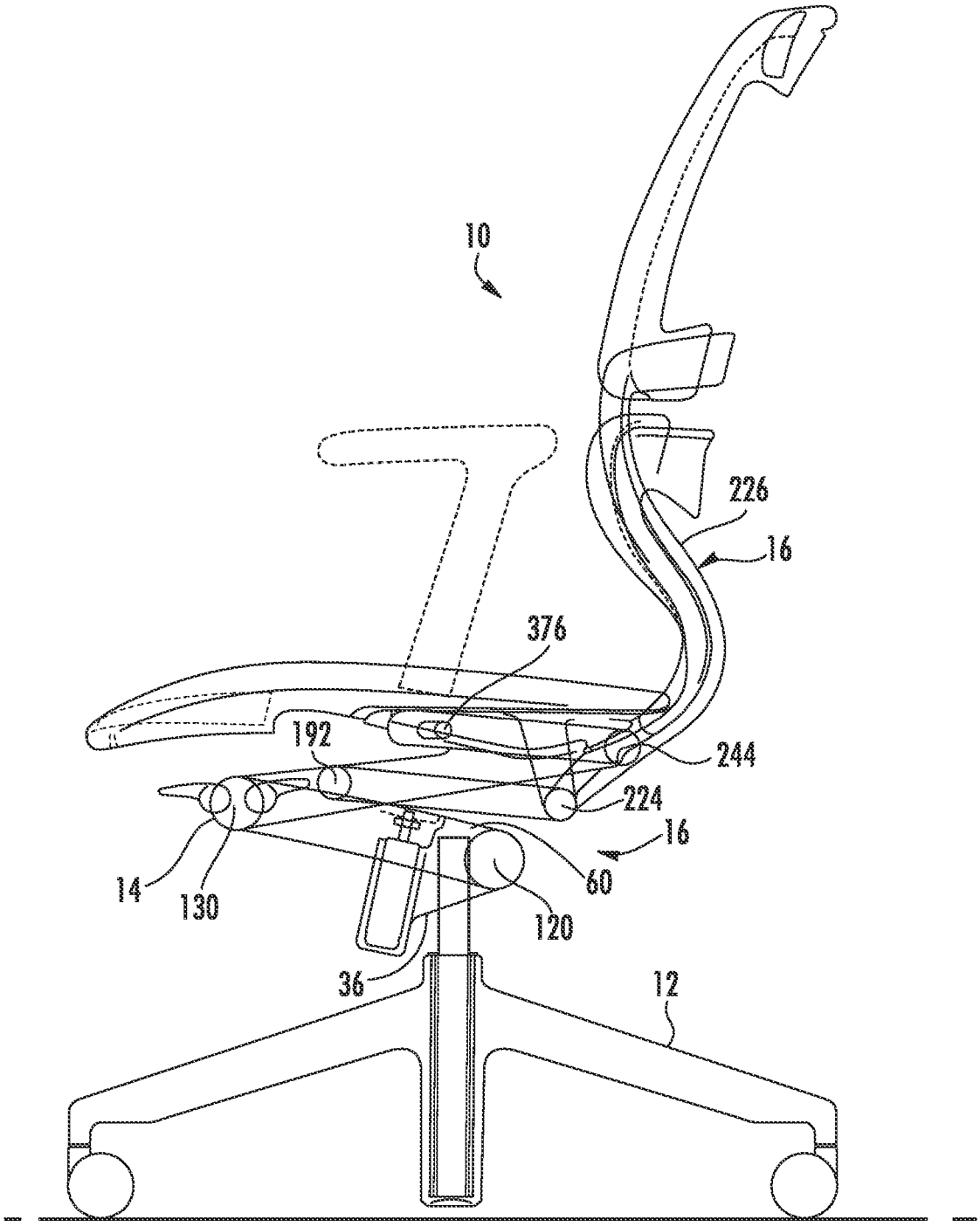
FIG. 2 is a view in side elevation of a task chair as disclosed herein.

An embodiment of the task chair pursuant to the present invention is indicated generally at 10 in FIGS. 1 and 2. There, the task chair 10 can be seen to be founded on a base assembly 12 that supports a linkage 14. The linkage 14 supports a seat and back assembly 16 to enable the members of the seat and back assembly 16 to move relative to one another and relative to the base assembly 12 to provide ergonomic support to the torso, back and legs of a seated person. The chair 10 is self-adjusting to maintain ergonomic support of a person's body as the person moves through different positions, such as during the performance of a variety of tasks.

The Base Assembly. The base assembly 2 comprises a plurality of radially extending legs 22, each with a caster 24 at the distal end thereof. At the center of the base assembly 12 is a vertically extending hollow housing 26, which can be closed at its lower end. The vertically extending hollow housing 26 supports a vertically extending shaft 28. As can be best seen in FIG. 4, a cylinder 50 inside the housing can be operated by the seated person to raise and lower the linkage 14 and seat and back assembly 16 to a comfortable height.

A block 36, which is supported on the base assembly 12, includes an elongated body 38. At one end of the elongated body 38 is a downwardly directed vertically extending opening 40. The vertically extending opening 40 is adapted to receive and be frictionally connected to an upper end of the vertically extending shaft 28 so that the block 36 is fixedly coupled to the vertically extending shaft 28.

The elongated body 38 of the block 36 includes a lateral extending opening 42 to a rearward side of the vertically extending opening 40. The elongated body 38 further includes a housing 44 defining an upwardly facing recess 46 to a forward side of the vertically extending opening 40. The upwardly facing recess 46 removably receives the cylinder 50, which has an upwardly facing piston rod 52 for adjusting the forward tilt of the chair 10 by bearing against a portion of the linkage 14.

Figure 10:
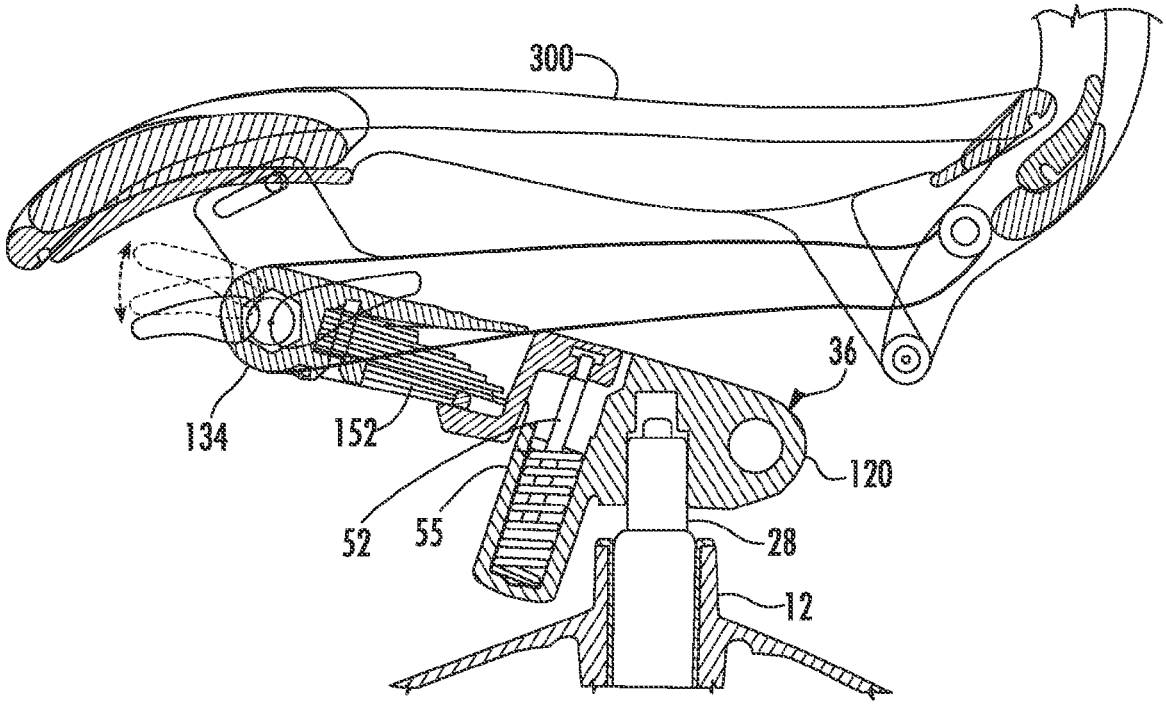
FIG. 10 is a cross-sectional view in side elevation of a further embodiment of the task chair.
Figure 11:
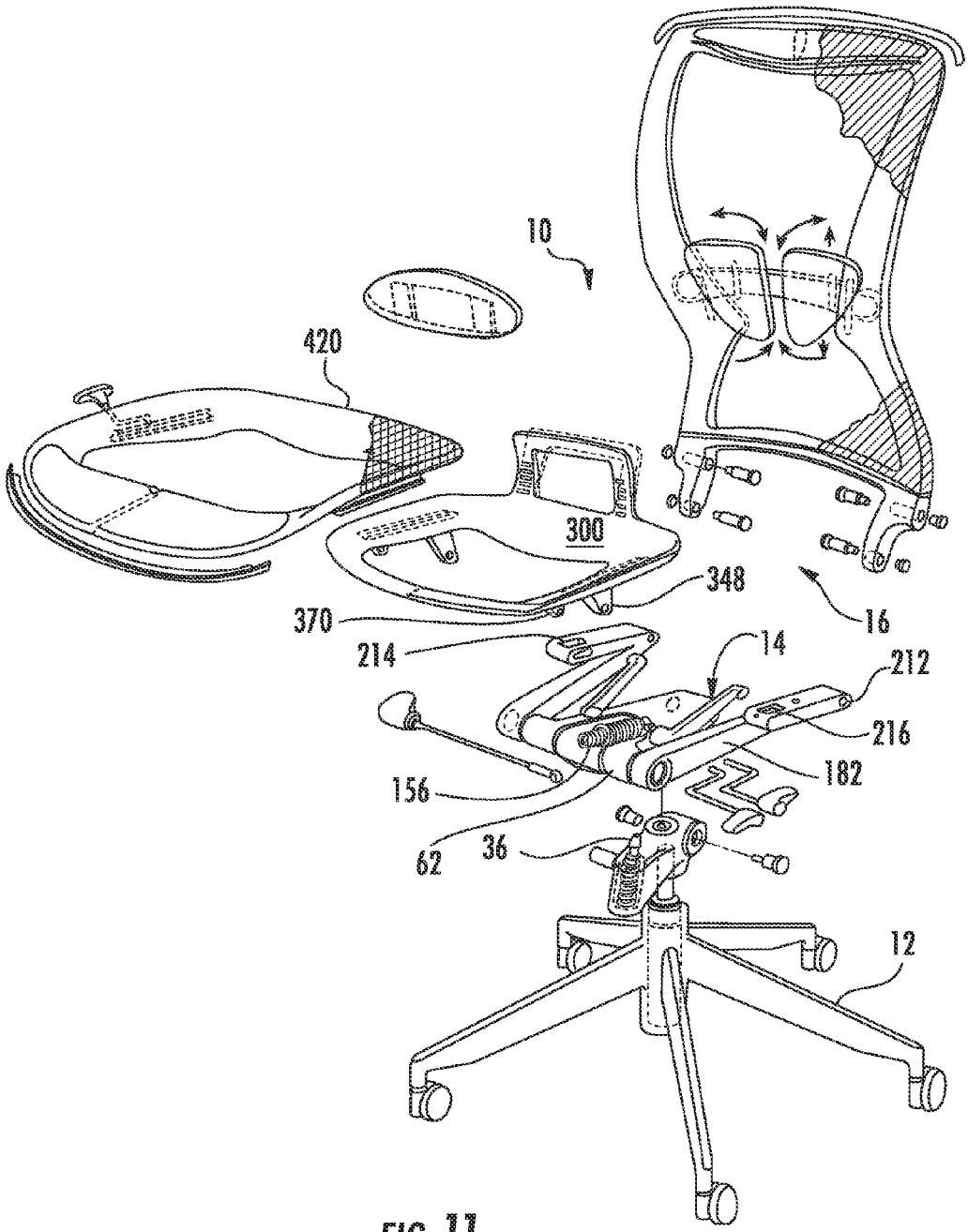
FIG. 11 is an exploded perspective view of still another task chair according to the instant invention.

In alternative embodiments, as in the embodiment of FIG. 10 and the embodiment of FIG. 11, the cylinder 50 can be replaced by a compression spring 55, which again can retain a rod 52. Any appropriate means, including those depicted herein, can be employed for adjusting tension in the spring. With this, the present embodiment of the task chair 10 can be adjusted to accommodate occupants ranging from the very light to the very heavy with no change in overall structure. Equally advantageously, the forward portion of the chair seat can exhibit a downward tilt during forward leaning of the chair by an exploitation of the synchronized mechanism of the chair. Bearing in mind the need for different tilting angles of a task chair over a typical workday, the synchronized, ergonomically friendly tilting of the present task chair provides useful advantages to the user.

Figure 4:
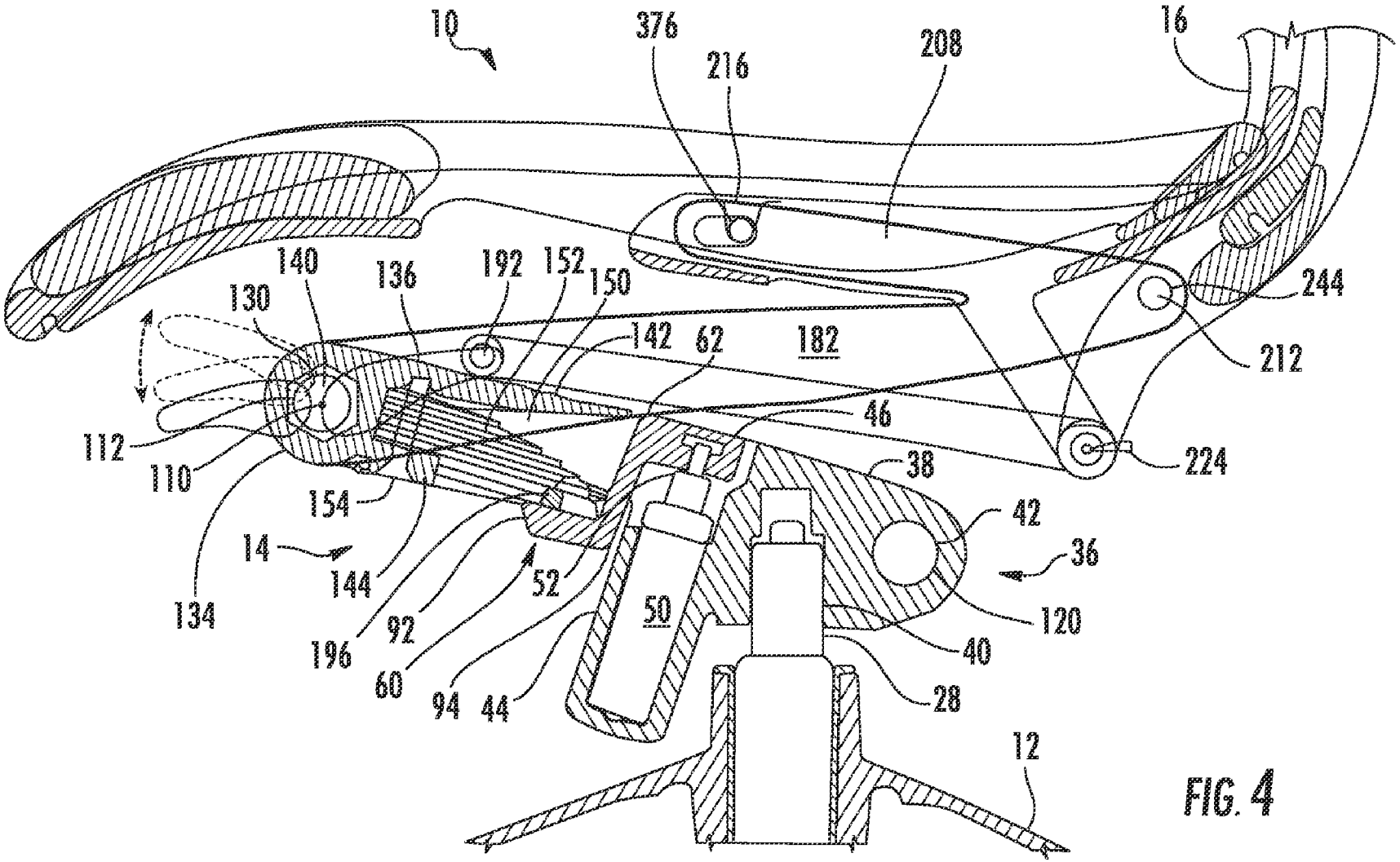
FIG. 4 is a cross-sectional view in side elevation of a task chair under the instant invention.

Preferably, to better enable the cylinder 50 to control the forward tilt of the chair 10, the axis of the upwardly facing recess 46 is tilted so that, as best seen in FIG. 4, it is inclined toward the vertically extending opening 40 at a given angle, such as approximately 15 degrees. With this, the upper end of the upwardly facing recess 46 will be closer to the vertically extending opening 40 than the lower end of the upwardly facing recess 46. An actuator (not shown) can be used for selective actuation of the cylinder 50 to permit movement of the piston 52 in and out of the cylinder 50 thereby to change the angle of the linkage 14.

The Linkage. The linkage 14 is formed by a plurality of components that are pivotally connected, such as by pivot pins, for interrelated relative movement. The linkage 14 includes a bracket 60. As seen in FIG. 1, the bracket 60 has the general shape of the letter "H." The bracket 60 has a central bridge 62 that supports laterally spaced rearwardly extending legs 64 and laterally spaced forwardly extending legs 70. In this example, the inner facing walls of the rearwardly extending legs 64 and the inner facing walls of the forwardly extending legs 70 are generally parallel to each other. The outer walls of the forwardly extending legs 70 diverge while the outer walls of the rearwardly extending legs 64 converge so that the forwardly extending legs 70 are substantially thicker than the rearwardly extending legs 64 and thus are able to support a greater load. The rearmost ends of rearwardly extending legs 64 include transversely extending openings 102.

As FIG. 4 shows, the central bridge 62 has a substantial thickness. It includes an opening 90 on its downwardly facing surface to receive the upper end of piston rod 52, it also includes a forwardly extending ledge 92 that is supported below the central bridge 62 by a downwardly extending apron 94. The forwardly extending ledge 92 extends partially into the space between forwardly extending legs 70.

With combined reference to FIGS. 1 and 4, one sees that the bracket 60 is pivotally connected to the block 36 by a pivot pin 120 that extends through the horizontally extending opening 42 in the elongated body 38 of block 36 and the transversely extending opening 102 in the rearwardly extending legs 64 of bracket 60. With this, movement of piston rod 52 in and out of cylinder 50 causes the bracket 60 to pivot upwardly and downwardly around pivot pin 120.

The anterior of the forwardly extending legs 70 support outwardly and laterally extending collars 110 each of which has a transversely extending opening 112. A horizontally extending pivot pin 130 is supported for pivotal movement in the transversely extending openings 112. The ends of pivot pin 130 extend beyond the collars 110. The intermediate part of the pivot pin 30, which is disposed inboard of the collars 110, is fixed to leaf spring housing 134.

As seen in FIG. 4, the leaf spring housing 134 includes a block 136 having a laterally extending opening 140, an elongated tail 142 that extends rearwardly from the upper portion of the block 136, and a shorter tail 144 that extends rearwardly from the lower portion of the block 136 in underlying relation to the elongated tail 142. The space between the elongated tail 142 and the shorter tail 144 defines a pocket 150 into which a leaf spring stack 152 comprised of a plurality of leaves of spring steel of progressively different length are received. The leaf spring stack 152 may be retained in the pocket 150 by a suitable fastener such as the rivet or screw 154.

Figure 5:
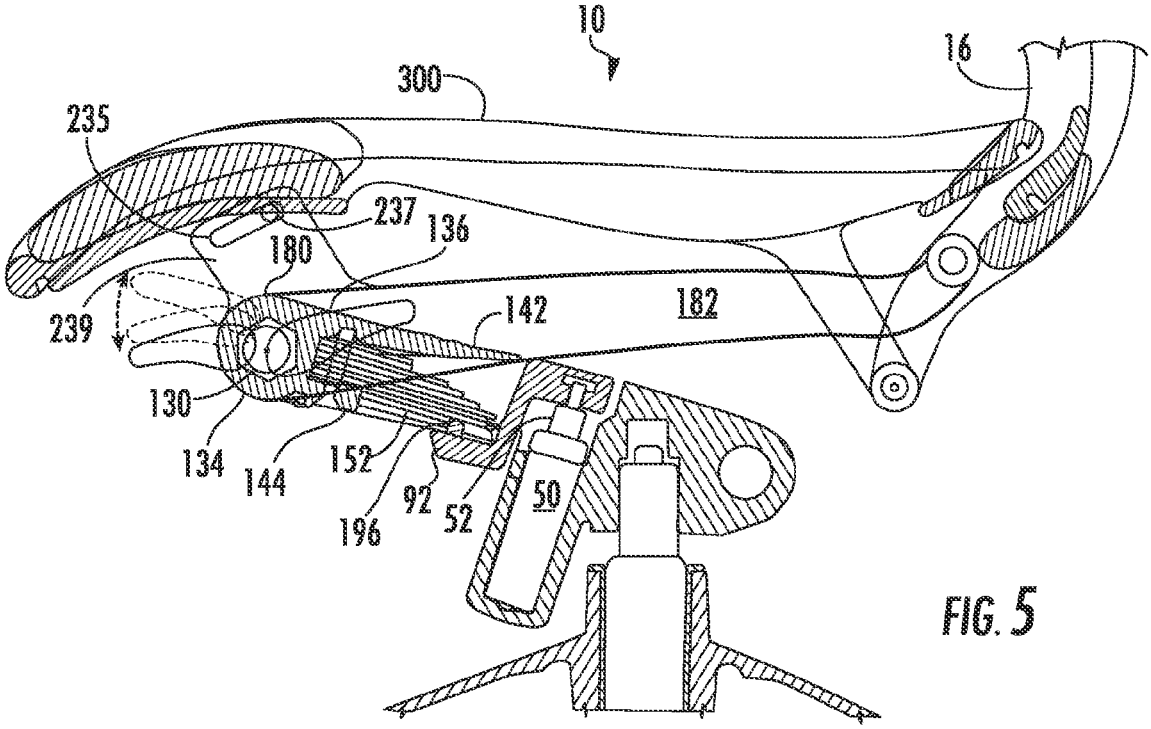
FIG. 5 is a cross-sectional view in side elevation of an alternative task chair.
Figure 6:
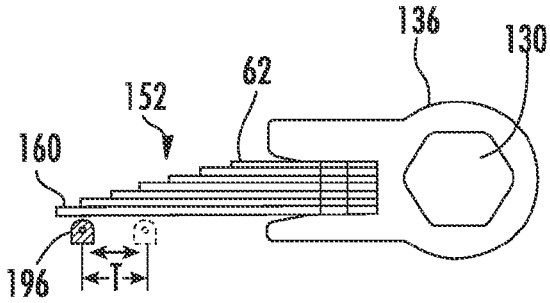
FIG. 6 is a view in side elevation of a leaf spring stack.

Looking additionally to FIGS. 5 and 6, one can see that the leaf spring stack 152 is arranged so that the longest leaf spring 160 is at the bottom of the stack and the shortest leaf spring 162 at the top. The interior wall of the elongated tail 142 is tapered toward the distal end thereof to maximize the space in which the leaf spring stack 152 can flex. When in a non-deflected disposition, the distal end of the longest leaf spring 160 in the leaf spring stack 152 lies adjacent to the forwardly extending ledge 92.

The block 136 is fixed to pivot pin 130 so that they move together. Therefore, when piston 52 expands in cylinder 50, it increases the tension in leaf spring stack 152 to urge the pivot pin 130 to rotate counter-clockwise as depicted in FIG. 5. This force is resisted by, among other things, the weight of the person sitting in the chair. In addition to its primary function of defining the pocket 150, the elongated tail 142 also serves the salutary functions of minimizing the opportunity for injury and of concealing the leaf spring stack 152 thereby increasing the aesthetics of the chair.

A movable force-bearing protuberance 196 can be retained between the leaf spring stack 152 and the ledge 92 thereby to enable an adjustment of the deflection characteristics of the spring stack 152 and the pivoting movement characteristics of the chair 10 in general in response to the movement of a seat occupant. More particularly, the protuberance 196, which can be retained relative to the ledge 92, can be slidable between forward and rearward positions to adjust the effective location of the application of force from the block 36 upon the leaf spring stack 152. The protuberance 196 can be movable by any effective adjustment arrangement, such as by the rod and gearing adjustment arrangement 198 of FIG. 1. Thus, the support provided by the spring stack 152 and the block 36 on the links 182 and, derivatively, the seat occupant. Since the deflection of the spring stack 152 is a function of the moment arm of the applied force, a movement of the protuberance 196 will enable an accommodation of different seat occupants.

The ends of horizontally extending pivot pin 130 are fixed to the ends 180 of links 182. Therefore, the block 136, pivot pin 130 and links 182 are all fixed to each other and are mounted for pivoting movement together in laterally extending collars 110. The links 182 are angularly disposed relative to each other so that they are closer at their proximal ends where they are connected to the horizontally extending pivot 130 and are spread at their distal ends to support the seat and back assembly 16.

Figure 3:
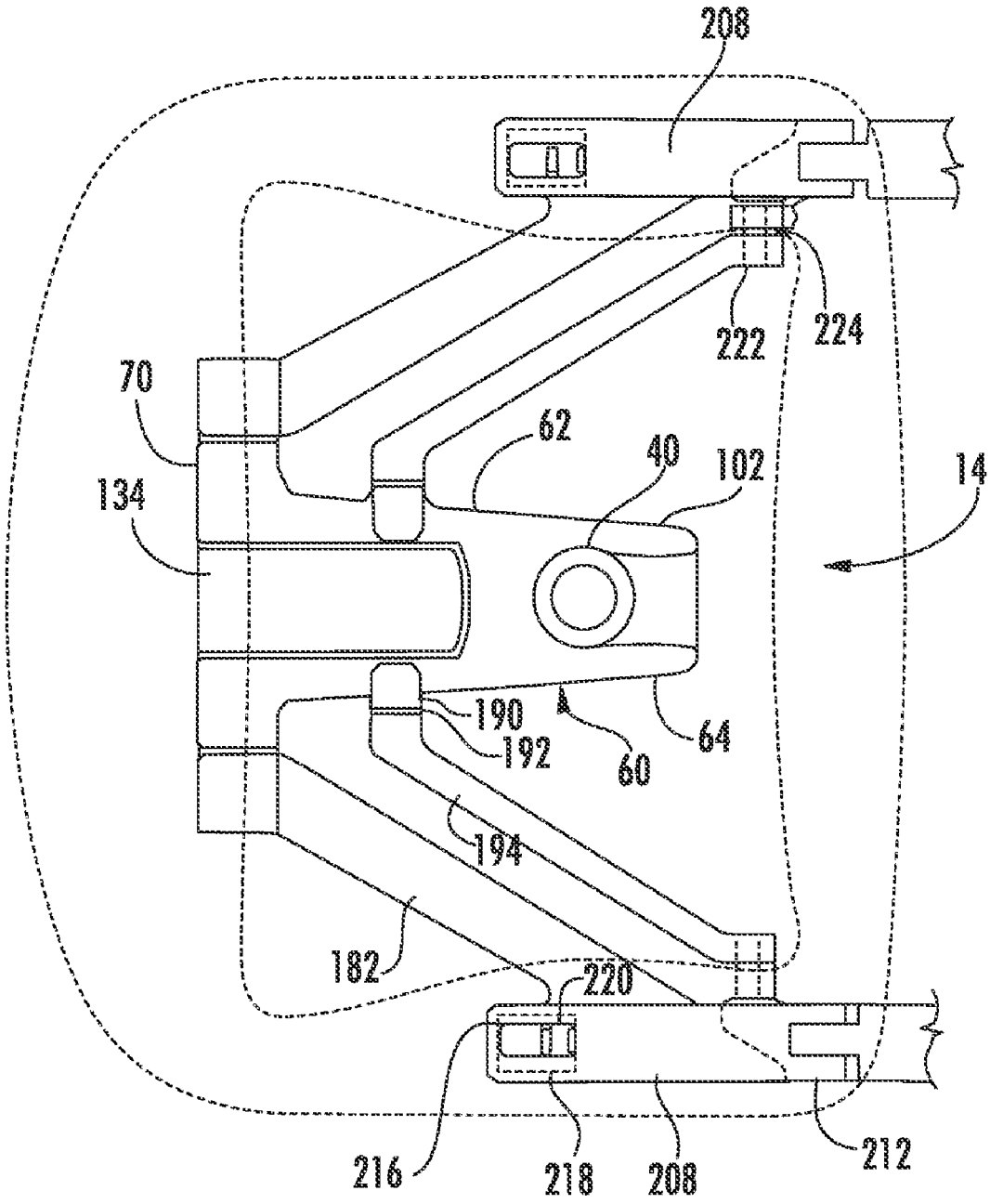
FIG. 3 is a top plan view of a linkage portion of a task chair.

As FIGS. 1, 3, and 4 show, each of links 182 comprises an elongated rearwardly extending body that supports at its distal end a laterally outwardly extending elongated raised boss 208. The rearmost part of the raised boss 208 includes a transversely extending opening 212. A second transversely extending elongated opening 216, which is in the form of an inverted "T", is at the forward end of raised boss 208. The opening 216 includes a transverse portion 218 and a leg portion 220, which extends upwardly from the transverse portion 218.

With continued reference to FIGS. 1 and 3, the bracket 60 also includes two intermediate laterally outwardly extending collars 190 that are supported on the outer walls of forwardly extending legs 70 and which are spaced rearwardly of the collars 110. Each of the intermediate collars 190 is pivotally connected by a pivot, pin 192 to a first end of each link 194. The second end of each link 194 includes a transverse opening 222. In a manner similar to links 182, links 194 are angularly disposed relative to each other so that they are closer to at their proximal ends where they are connected to the intermediate collars 190 on bracket 60 and are spread at their distal ends to further support the seat and back assembly 16. The axis of transversely extending pivot pin 130 is parallel to the transversely extending openings in intermediate collars 190 and the transversely extending openings at the distal ends of links 182 and 194.

Figure 14:
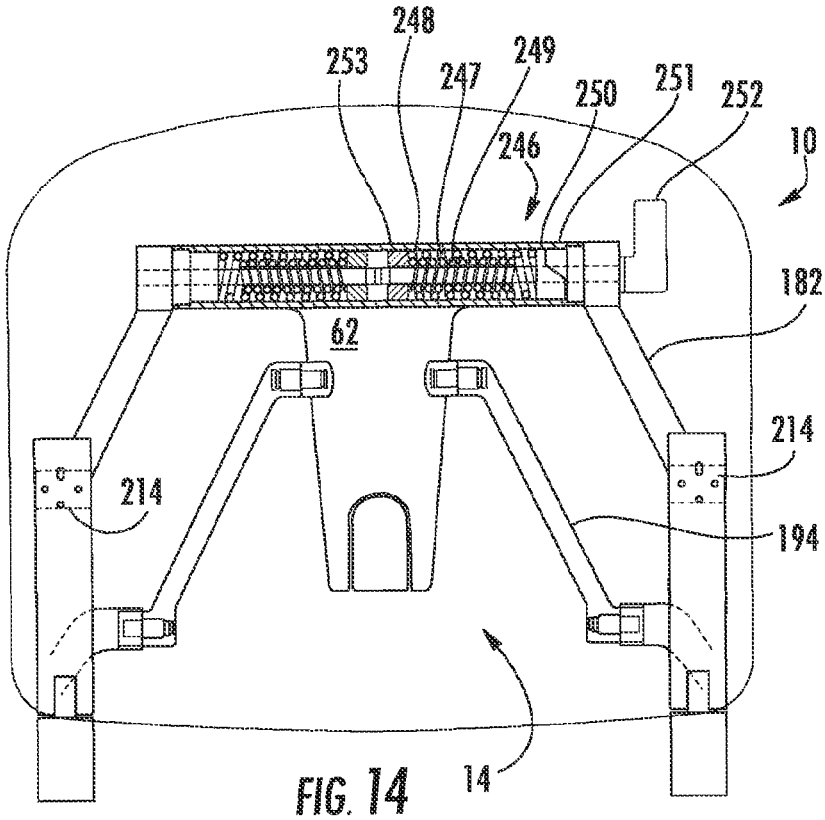
FIG. 14 is a partially sectioned top plan view of yet another embodiment of a task chair under the present invention.
Figure 15:
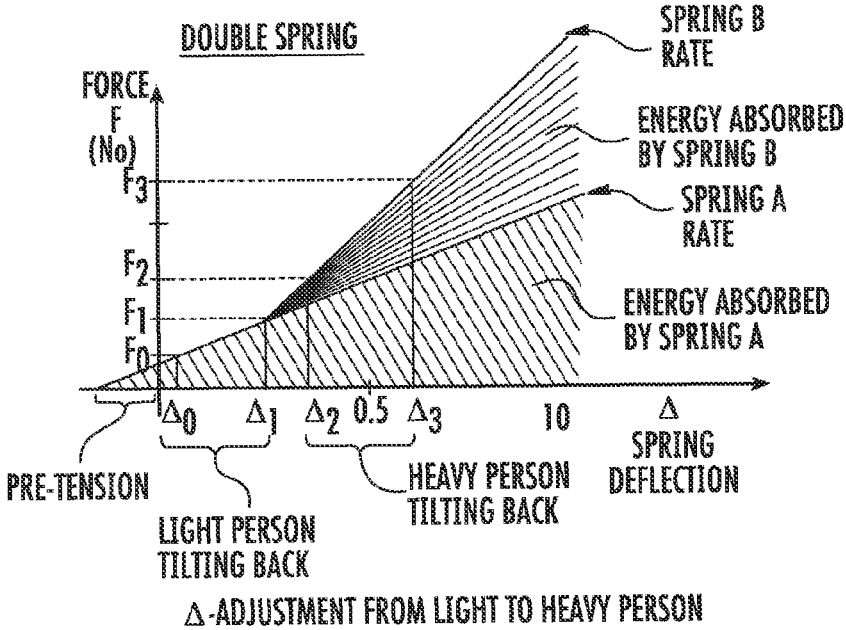
FIG. 15 is a chart of spring deflection per unit of applied force.

In the alternative construction of FIG. 14, first and second opposed double spring arrangements 246 are employed to enable a pivoting of the links 182 and, derivatively, the support of a seat occupant. The double spring arrangements 246 are disposed within a tubular housing 247. Each double spring arrangement 246 has an inner spring 248 and an outer spring 249, A stop member 253 is disposed inboard of the inner and outer springs 248 and 249, and first and second end members 250 and 251 are disposed outboard of the inner and outer springs 248 and 249. Each of the end members 250 and 251 is cammed whereby the double spring arrangements 246 provide proportional resistance to a deflection of the links 182. FIG. 15 provides a graph of spring deflection per unit force. There, one sees that the outer spring 249 will first absorb energy and will then be assisted by the inner spring 248 thereby to enable ergonomic support of both light and heavy persons, in the embodiment of FIG. 11, a spring arrangement 156 provides resistance to the pivoting of the links 182 relative to the central bridge 62.

The Seat and Back Assembly. Referring to FIGS. 1 and 2, the seat and back assembly 16 comprises an upper back support 226 and a seat and lumbar support 228. The upper back support 226 comprises a generally U-shaped frame 230 having two downwardly extending spaced generally parallel legs 232 which are connected by a transversely extending member 234 so that the U-shaped frame 230 defines a downwardly facing opening 236.

The lower end 238 of the outer wall of each of leg 232 has an inwardly directed and downwardly facing shoulder 248 which reduces the thickness of the lower end 238 so that it is can receive the raised bosses 208 on links 182. Each lower end 238 includes a transversely extending intermediate opening 240 and a lower opening 242. Lower opening 242 is at the end of the leg while opening 240 is spaced slightly above opening 242. A pivot pin 224 connects the lower transverse opening 242 with the opening 222 in link 194 and one of the lugs on seat and lumbar support, which will be described Pivot pin 244 connects the intermediate opening 240 and opening 212 at the rear of boss 208.

The transversely extending member 234 of the "U" shaped frame 230 includes to cushion structure 254 comprising a molded generally concave frame 258 whose lower portion 260 is connected to the transversely extending member 234 of the U-shaped frame 230 by rivets 264 or a suitable adhesive. The concave frame 258 has inner and outer peripheries 270 and 272 which are positioned with the inner periphery 270 being rearward of the outer periphery 272 to thereby define the concavity of the frame 258.

The upper portion 278 of cushion structure 254 supports an adjustable upper back supporting element 286 whose thickness can be varied by suitable means. Overlying the molded frame 258 and adjustable upper back supporting, element 286 is a layer of tightly drawn mesh 288 which may be covered by a layer of cushioning 290. The layer of tightly drawn mesh 288 and the layer of cushioning 290 cooperate to support the upper portion of the back. The usefulness of the layer of tightly drawn mesh 288 is enhanced by the concavity of the molded frame 258 since the mesh 288 is supported by the outer periphery 272 of the frame 258 thereby providing a greater span of material than would be achieved than if the layer of mesh 288 were supported by the inner periphery 270.

The seat and lumbar support 228 includes of a one-piece frame 300 which may be comprised of a rigid molded plastic or suitable metal. It includes a seat supporting portion 302 and lumbar supporting portion 310 extending upwardly from the rear of the seat supporting portion 302. The seat and lumbar support 228 may be integral or, if preferred, its components can be multiple separate pieces that are welded, glued, riveted or otherwise coupled. The seat supporting portion 302 comprises a generally concave frame 312 with inner and outer peripheries 320 and 322 where the outer periphery 322 is higher than the inner periphery 320. Each of the sides 328 of the seat supporting portion 302 supports a longitudinally extending and upwardly facing channel 338 on its upper surface.

Supported on the bottom surface of each of the sides 328 of the seat supporting portion 302 and just anterior to its rear edge is a downwardly and rearwardly extending lug 348. Each lug 348 has a transversely extending opening 354. The lugs 348 are spaced from each other a distance sufficient to enable them to fit between the lower ends of legs 232 and the ends of links 194 on each side of the linkage 14. They are connected to the links 194 and legs by aforementioned pivot pins 224

At the front end of each side 328 of the seat portion 302 is a shorter downwardly extending lug 370. Each lug 370 has a transversely extending, opening 372. The lugs 370 are spaced laterally from each other the same distance as the distance between the openings 216 at the front of the raised bosses 208 on each side of the chair 10 and are restrained for pivotal sliding movement in the openings 216 by pivot pins 376. It should be understood that the present description may relate to the arrangement of parts on one side of the chair 10 with the arrangement on the other side of the chair 10 being a mirror image of that shown.

Figure 12:
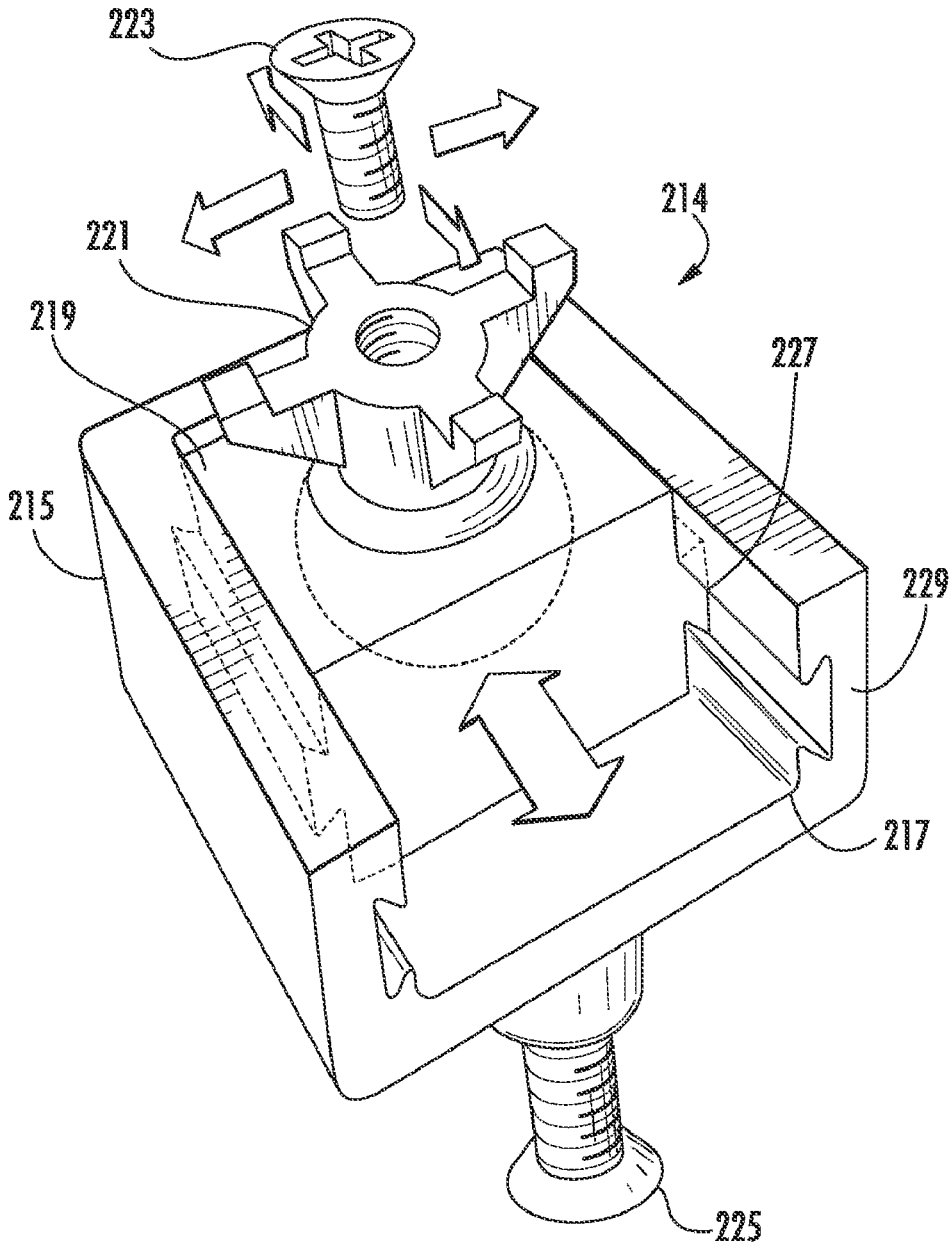
FIG. 12 is a perspective view of a kinematic joint as employed under the present invention.
Figure 13A:
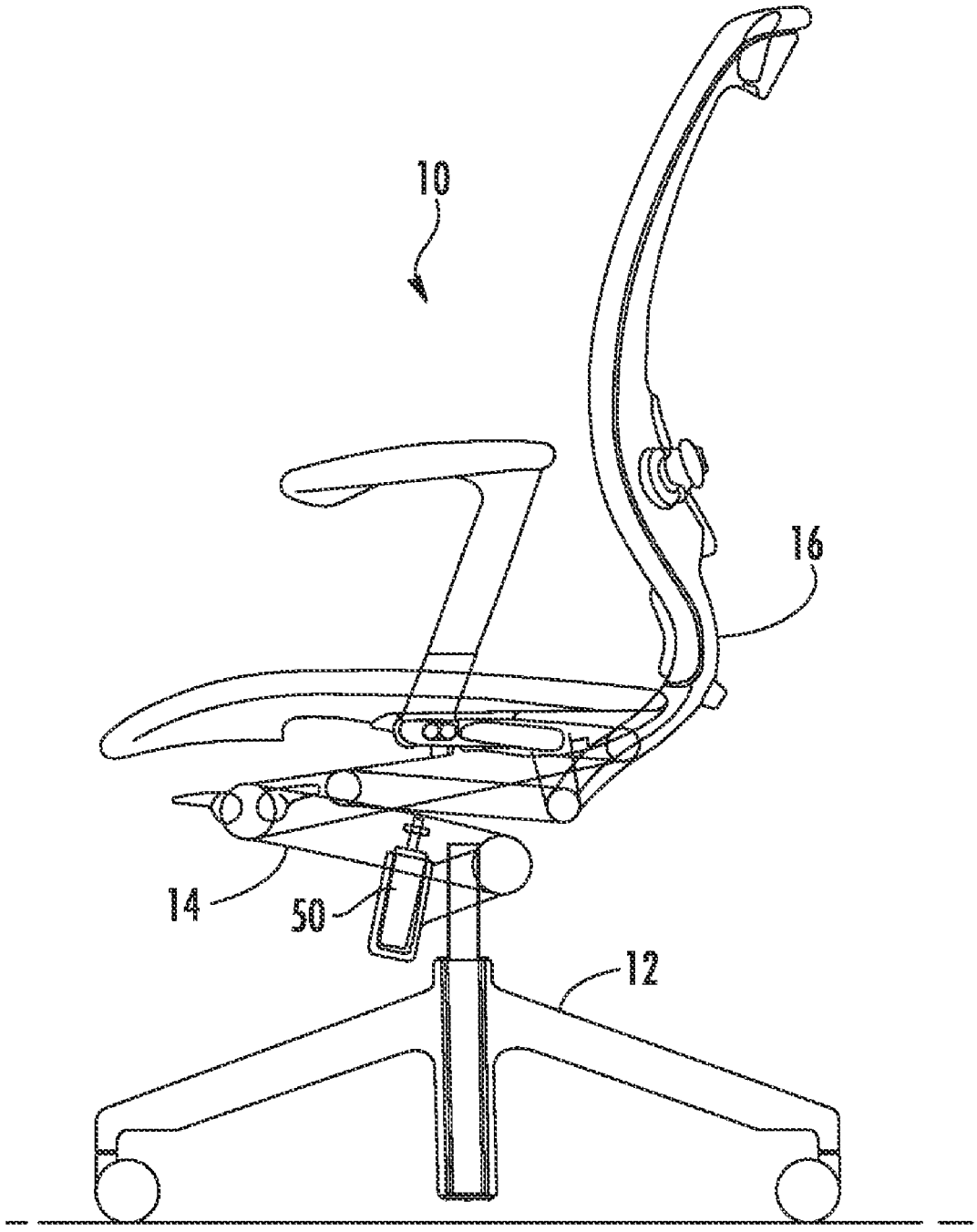
FIGS. 13A through 13E are views in side elevation of a task chair as taught herein in varying degrees of tilt.
Figure 13B:
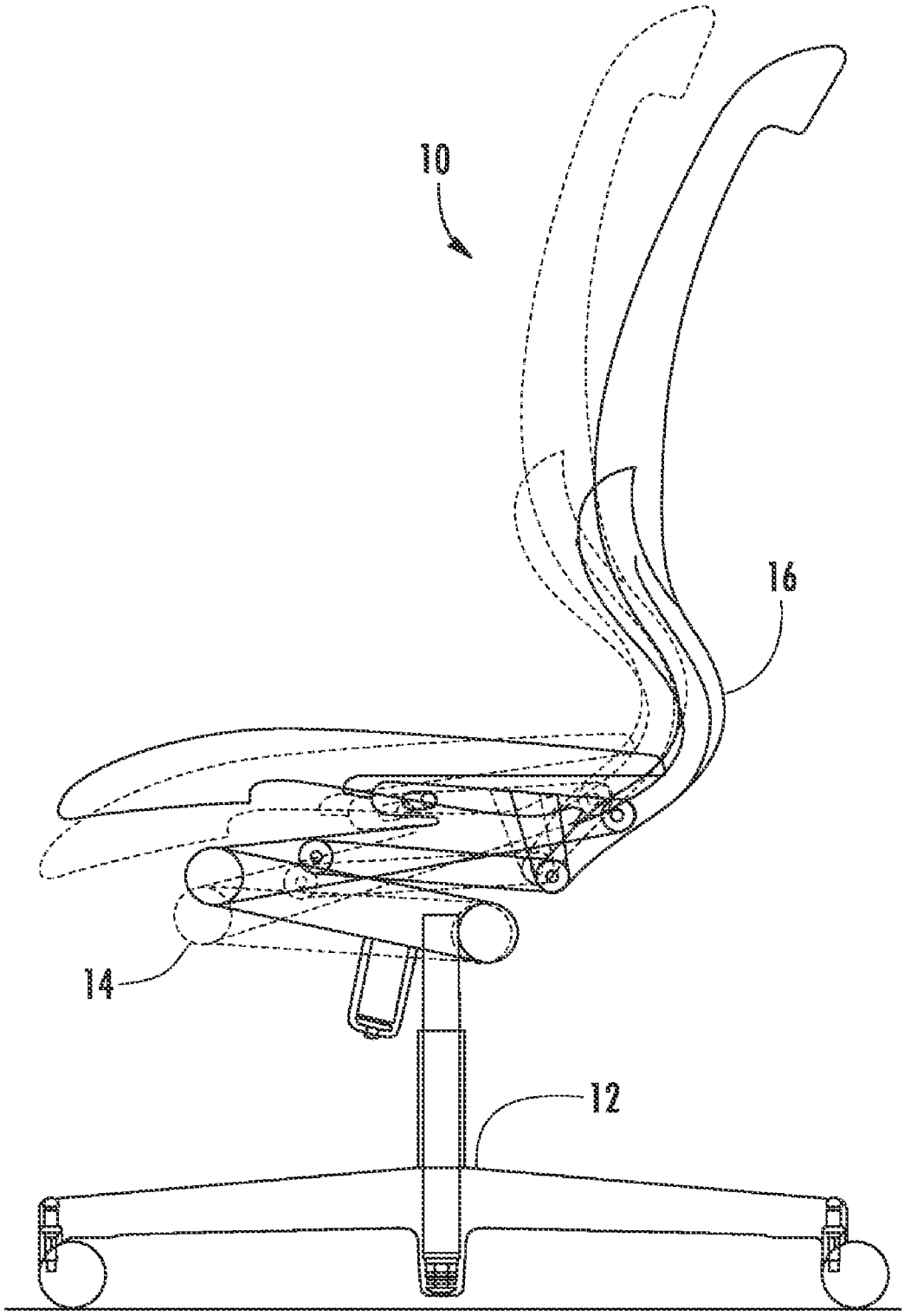
Figure 13C:
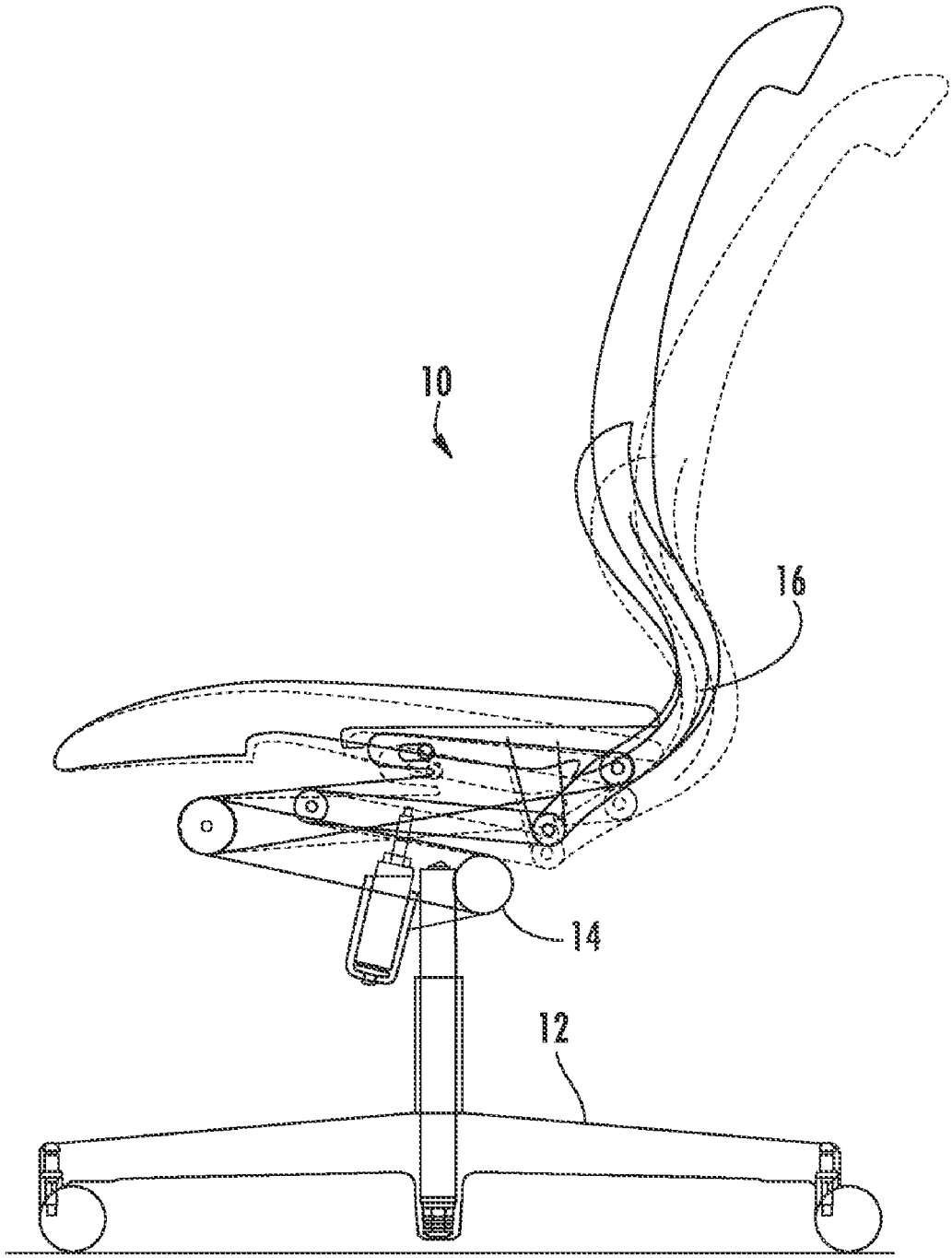
Figure 13D:
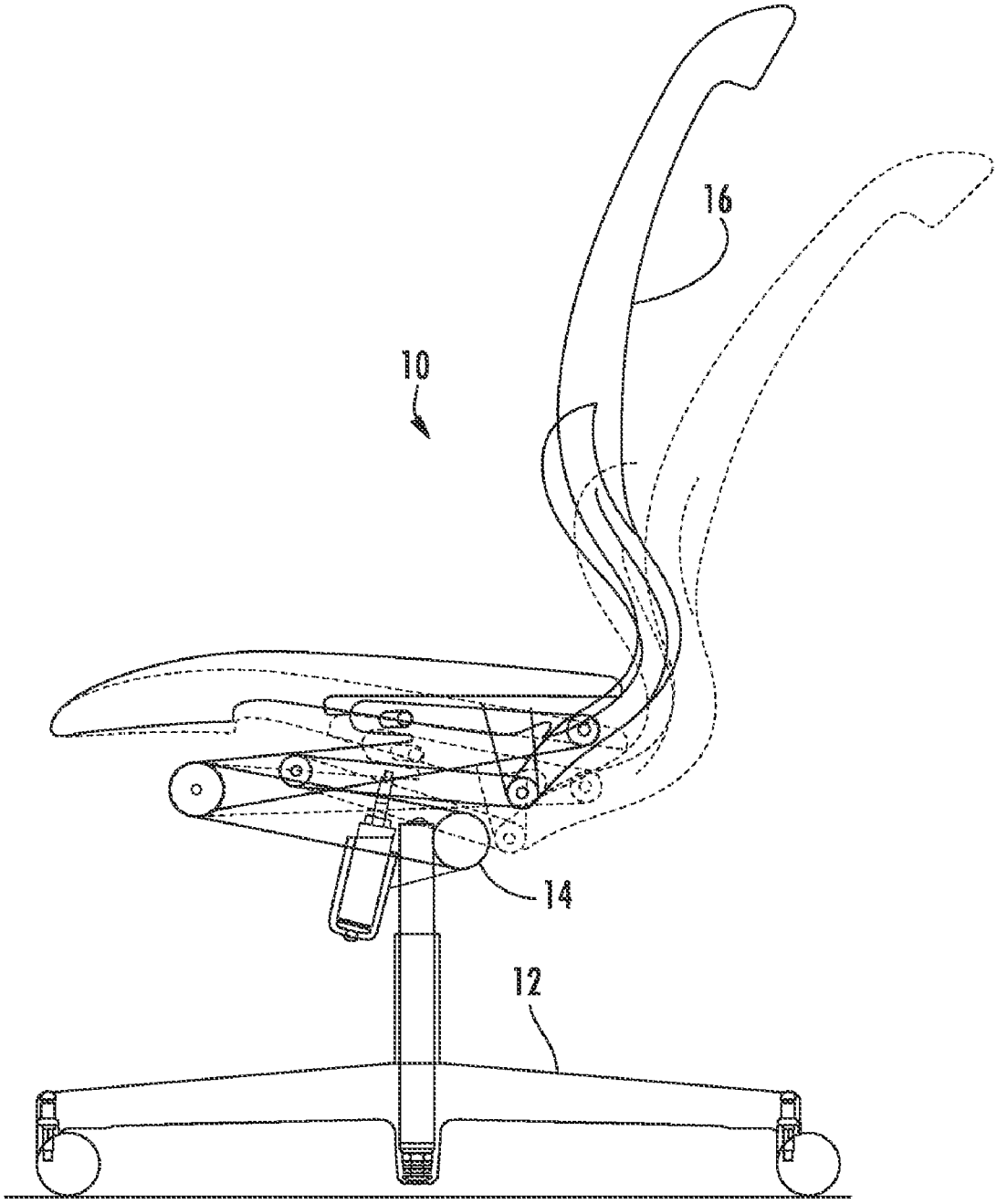
Figure 13E:
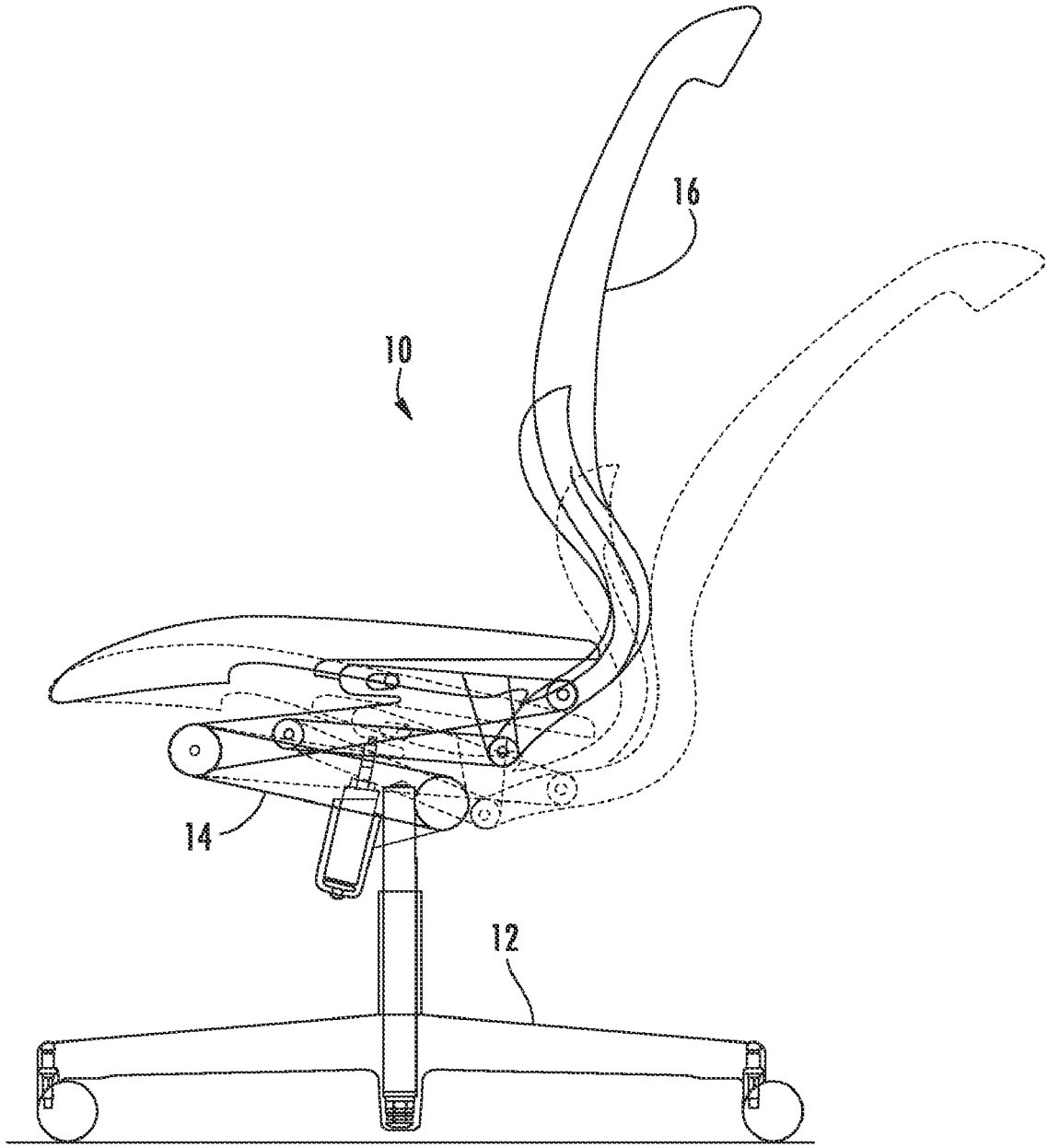

As shown in the alternative embodiment of FIG. 11 and then in a larger view in FIG. 12, a kinematic joint 214 can be used in certain constructions to couple the seat supporting portion 302 to the linkage 14. The kinematic joint 214 can enable multi-directional pivoting and sliding movement by use of a housing 215 having a channel 217 therein for slidably receiving a block 219 wherein the block 219 has a pivoting member 219 retained relative thereto. The block 219 can have a wedge-shaped ridge 227 for slidably engaging a correspondingly shaped channel 229. The pivoting member 219 can be universally pivotable relative to the block 219 by, for example, a ball and socket connection. The kinematic joint 214 can engage the seat portion 302 by a seat connector 223 and can engage the linkage 14 through a linkage connector 225 thereby to provide a pivoting, sliding connection therebetween. In FIG. 5, a pivoting, sliding engagement between the seat portion 302 and the link 182 is achieved by a slot 235 in an extension 239 of the link 182 that engages a pivot pin 237 retained relative to the seat portion 302.

Looking again to FIG. 1, the lumbar supporting portion 310 of the seat and lumbar support 228 Can extend upwardly from the rear part of the seat supporting portion 302. The lumbar supporting portion 310 comprises a generally S-shaped frame 380 that is curved so as to generally follow the curvature of the spine. The upper portion of the S-shaped frame 380 supports a pad 386. The pad 386 can slide up and down on the frame 380 and its thickness can be increased as desired as will be explained. Preferably, the lumbar supporting portion 310 is made from a rigid flexible material such as a suitable thermoplastic or metal so that it yieldably supports the lower back to provide passive ergonomic support.

Pad 386 can be slidably connected to a strip 390, which comprises an elongate, stiff strip of material. The strip 390 can be connected as by rivets or the like to the sides of frame 380. The strip 390 extends through an elongated transversely extending opening 394 in the pad 386. The vertical position of the pad 386 can be adjusted by simply sliding it vertically along the strap 390 until it is at a comfortable height.

The stiffness of the pad 386 may be controlled by an adjustment mechanism 400 that in this embodiment includes an adjustment wheel 402 that is rotatably retained relative to the S-shaped frame 380. The wheel 402 drives a threaded pin 412 that bears against the strap 390. Thus, rotation of the adjustment wheel 402 in one direction tends to cause the pad 386 to move toward the spine of the seated person sitting while rotation in the opposite direction moves the pad 386 away from a seated person's spine.

A seat pad 420 comprising a concave frame 424 having inner and outer peripheries 428 and 432 is supported on the seat supporting portion 302. On the lower surface of each side of the concave frame 424 is a track 436. The tracks 436 are complementary with and are adapted to engage the earlier mentioned upwardly facing channels 338 on the concave seat supporting portion 302. The channels 338 and tracks 436 permit the seat pad 420 to be slid forward and backward to be positioned in a convenient and comfortable position relative to the lumbar supporting portion 310 and upper back support 226. A suitable means, such as one or more detents, can be used to retain the seat pad 420 in a desired position. A layer of material, such as tightly woven mesh 440, can be stretched over the concave frame 424 spanning the outer periphery 432. If desired, a cushion 441 may be placed over the layer of tightly woven mesh 440.

Movement of the Linkage. For the purpose of describing the movement of the parts of the chair 10 relative to each other, the linkage 16 is illustrated in FIGS. 2 and 4 where six pivotal connections are shown. The first pivotal connection is formed at pivot, pin 120 that pivotally connects block 36 to bracket 60. The second pivotal connection is at pivot pin 130, which is pivotally supported by laterally extending collars 110 on bracket 60 as shown in FIG. 1 and is fixed to spring stack 152 and links 182 as shown in FIG. 4. The third pivotal connection is at pivot pins 192 which pivotally connect the collars 190 at the mid-portion of bracket 60 to links 194 as shown in FIG. 3. The fourth and fifth pivotal connections are formed by pivot pins 224 and sliding pivot pins 376 which are at the rear and front of raised bosses 208. The fourth pivotal connection, which is defined by pivot pin 244, connects the rear of the boss 208 to one of the openings 240 in the lower ends of the legs 232 defining the chair hack 226. The fifth pivotal connection, which is defined by pins sliding pivot pins 376, pivotally connects the front lugs 370 on seat supporting portion 302 to the front of boss 208. The sixth pivotal connection is defined by pin 224, which pivotally connects the lowermost openings 242 in the legs 232 defining the chair back to the other ends of links 194 and to the rear lugs 348 on seat supporting portion 302.

Note that pivot, pins 192, 130, 376 and 224 define a trapezoid. Movement of the trapezoid controls the movement of the upper back support 226. The long sides of the trapezoid are defined pivot pins 192 and 224 on one side and pivot pins 130 and 376 on the other long side. The short sides are defined by pivots 130 and 192 on one side and pivots 224 and 376 on the other side. The advantageous relative movement of the various parts of the chair 10 can be understood by referring to the accompanying drawings.

The Normal Configuration. The normal configuration of the various links and pivots comprising linkage 14 is exhibited when the seat supporting portion 302 is in a horizontal position and the upper back support 226 is upright. In this configuration, a person would be seated upright in the chair 10 supported by the seat and lumbar support 228 and the upper back support 226. Pivot pin 130 is slightly higher than pivot pin 192, which is slightly higher than pivot pin 120. This follows from the fact that bracket 60 normally slopes from lower right to upper left (when viewed in left side elevation) and because pivots 120 and 192 are to the right pivot pin 130.

Forward Tilt. The forward tilt of the seat and lumbar support 228 is controlled by cylinder 50 and piston 52, which bears against bracket 60. This mechanism adjusts the linkage 16 to cause the seat 302 to pivot counter-clockwise (again when viewed in left side elevation) about pivot pin 120 so that the its front edge is below its normal position and the rest of the seat 302 is lowered slightly to continue to provide seating support and support for the lower back. Retraction of the piston rod 52 pivots bracket 60 counter-clockwise around pivot 120. This increases the horizontal distance between pivot pins 130 and 192 on the one hand and pivots 224 and 376 on the other hand. Simultaneously sliding pivot pin 376 moves forward and downward relative to pivot 224 against, the force of leaf spring stack 152 causing the seat and lumbar support 228 to pivot around pivot pin 224 to a position which is slightly lower and further forward.

Further, the upper back support 226 and the seat and lumbar support 228 are interrelated for cooperating movement to support the back of the seated person as that person leans forward and backward. Thus, because links 208 are pivotally connected to the upper back supporting portion 226 at pivot pin 224, the forward and downward movement of the sliding pivot pin 376 pulls the upper back support 226 forward to maintain supporting contact with the spine.

Leaning Forward. The chair 10 as described permits full adjustment for the comfort of a sitting person and adapts to their body without regard to whether they are leaning forward or are leaning back. When the seated person leans forward, the seat and lumbar support 228 move forward so that the lumbar spine is supported. This occurs because when the seated person leans forward in the chair the seat and lumbar support 228 pivots counter-clockwise around pivot pin 224 (again assuming a view in left side elevation). This movement, is in part accommodated by pivot 376 sliding forward in the elongated transversely extending opening 216. The force of the person's body against spring stack 152 is diminished, the link 182 pivots counterclockwise around pivot pin 130, and the back 226 pivots forward about pivot pin 224 to support the person's back.

Since links 208 are connected between sliding pivot pin 376 and pivot pin 212 on the upper back support 226, the upper back support 226 is also pivoted forward around pivot 224. However, its range of movement is greater than the range of movement of the seat portion and lumbar supporting portions 302 and 310. This is because the angle through which the upper back support 226 pivots increases as the distance between pivots 212 and 224 increases. Therefore, by adjusting the distance between pivot pins 212 and 220, the relative movement of the upper back support 226 to the lumbar support 310 can be varied. Thus, as the distance between pivot pins 212 and 224 increases, the incremental pivotal movement of the back support 226 around pivot pin 120 increases relative to the incremental pivotal movement of seat and lumbar support 228.

Leaning Backward in a similar manner when the person leans back in the chair 10, the seat and lumbar support 228 move backward. This is especially significant since as explained earlier, when a seated person leans back, the lumbar portion of the spine moves forward relative the to the upper portion of the spine. Nonetheless, the lumbar portion of the spine is still supported in the following manner. When the weight of the seated person it shifted forward, the force of the person's body against the spring stack 152 is increased. The link 182 pivots clockwise around pivot pin 130, and the upper back support 226 pivots backward to support the person's upper spine. FIGS. 13A through 13E depict in side elevation views of a chair in varying degrees of tilt.

Further, as the upper back support 226 moves clockwise, the seat supporting portion 302 is raised. This is because the upper back support 226 pivots around pivot pin 224 causing lug 348 on the underside of the seat supporting portion 302 to move upward. The difference in relative range of movement between the seat portion and lumbar supporting portion 302 and 310 and the upper back supporting portion 226 causes the lumbar supporting portion 310 to remain in contact with the lumbar portion of the spine of the person while the upper back supporting portion 226 supports the upper part of the spine. Therefore, since the seat and lumbar support 228 is one rigid item, the lumbar supporting portion 310 continues to support the lower spine as the upper back support 226 moves rearwardly. The difference in relative range of movement between the seat portion and lumbar supporting portion 302 and 310 causes the lumbar supporting portion 310 to remain in contact with the lower part of the spine of the person while the upper back supporting portion 226 supports the upper part of the spine. Since both the lumbar supporting portion 310 and the upper back supporting portion 226 are made to flex slightly when loaded, they tend to provide passive ergonomic support for the back.

Thus, when the upper back support 226 is pushed back as when a person leans back, the seat and lumbar support 228 move back somewhat, but remain forward of the upper back support 226 so that they support the lumbar portion of the spine. Further, it should be noted that upon leaning forward, the seat 300 pivots downwardly around pivot pin 224 to provide continued support for the upper leg. Further, both the upper back support 226 and the seat and lumbar support 228 also move forward while the seat and lumbar support 228 rotates downwardly around pivot pin 224 to accommodate the new position of the body.

Thus, what has been described is a task chair 10 that has substantial and dramatic ergonomic features in that it provides full and continuous support for the upper and lower back and seat of a person as he or she goes through an entire range of movement, such as while working at a desk or table. Thus, the supporting of the back and seat means that significant work can be accomplished without undue fatigue or the like affecting the capability of the worker.

Figure 7:
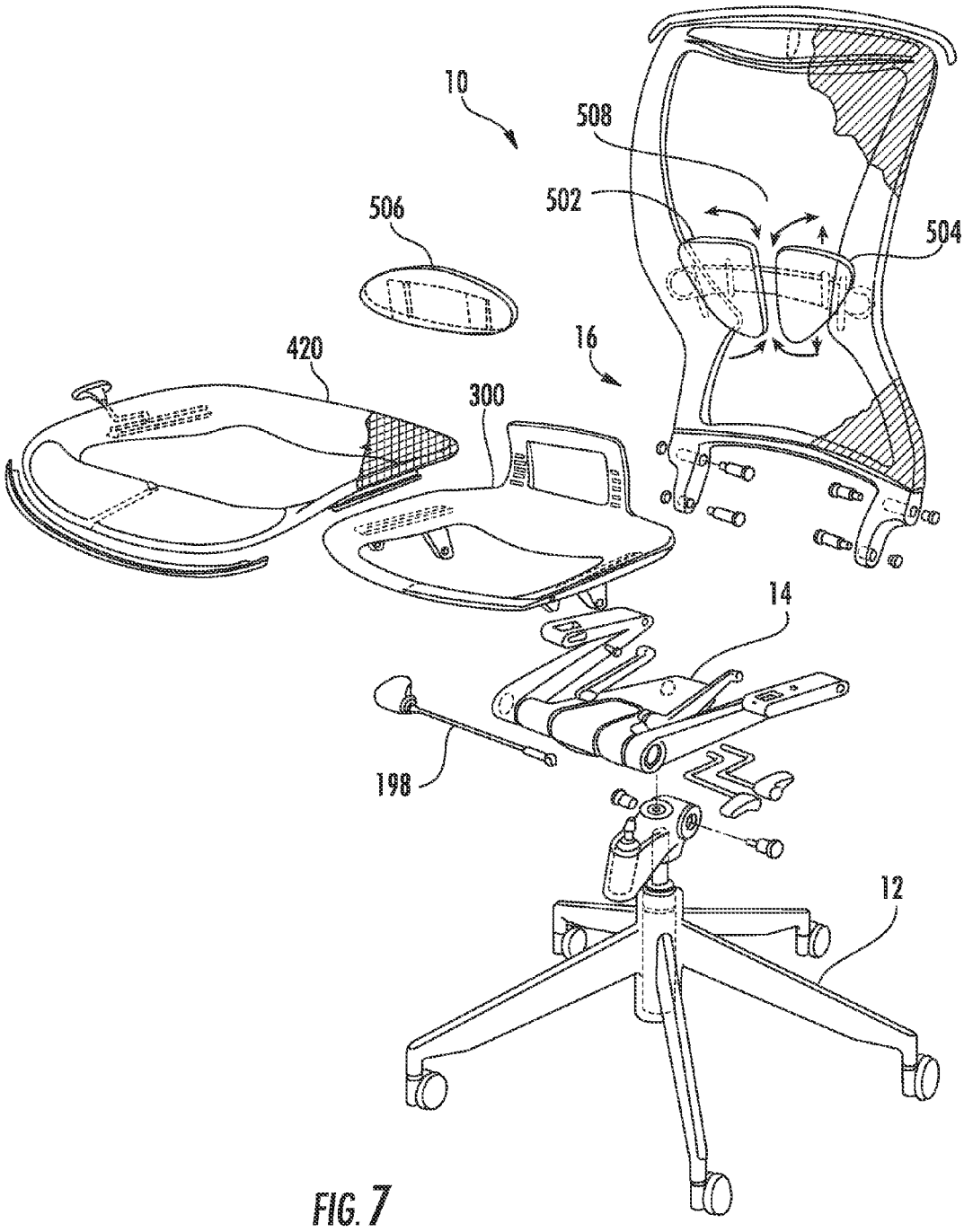
FIG. 7 is an exploded perspective view of another alternative task chair.
Figure 8:
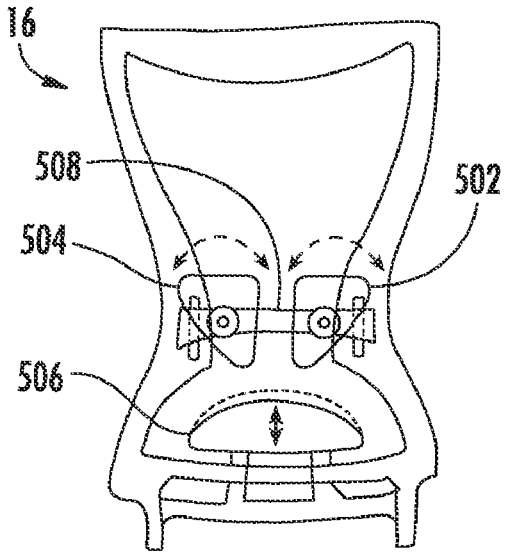
FIG. 8 is a view in rear elevation of a seat back of a task chair as disclosed herein.

Dual Back and Lumbar Supports. Looking to FIGS. 7 and 8, an embodiment of the task chair is disclosed wherein the dual supports 502 and 504 provide support to the back of the seat occupant while a lower lumbar support 506 provides lumbar support for the seat occupant. The dual supports 502 and 504 can be adjustable laterally and/or longitudinally relative to the seat back. The dual supports 502 and 504 could also be pivotable or rotatable to vary the support effectively provided to the seat occupant. As FIG. 8 shows, the supports 502 and 504 can be mounted to a vertically movable cross member 508 whereby their vertical location can be adjusted. Adjustment knobs 510 can enable a selective orientation of the supports 502 and 504. The supports 502 and 504 can be independently rotatable or dependently coupled by any one of numerous different possible means, such as gearing, an endless belt, frictional engagement, or any other effective means, such that a rotation of one support 502 or 504 will induce a rotation of the other support 504 or 502.

Figure 9A:
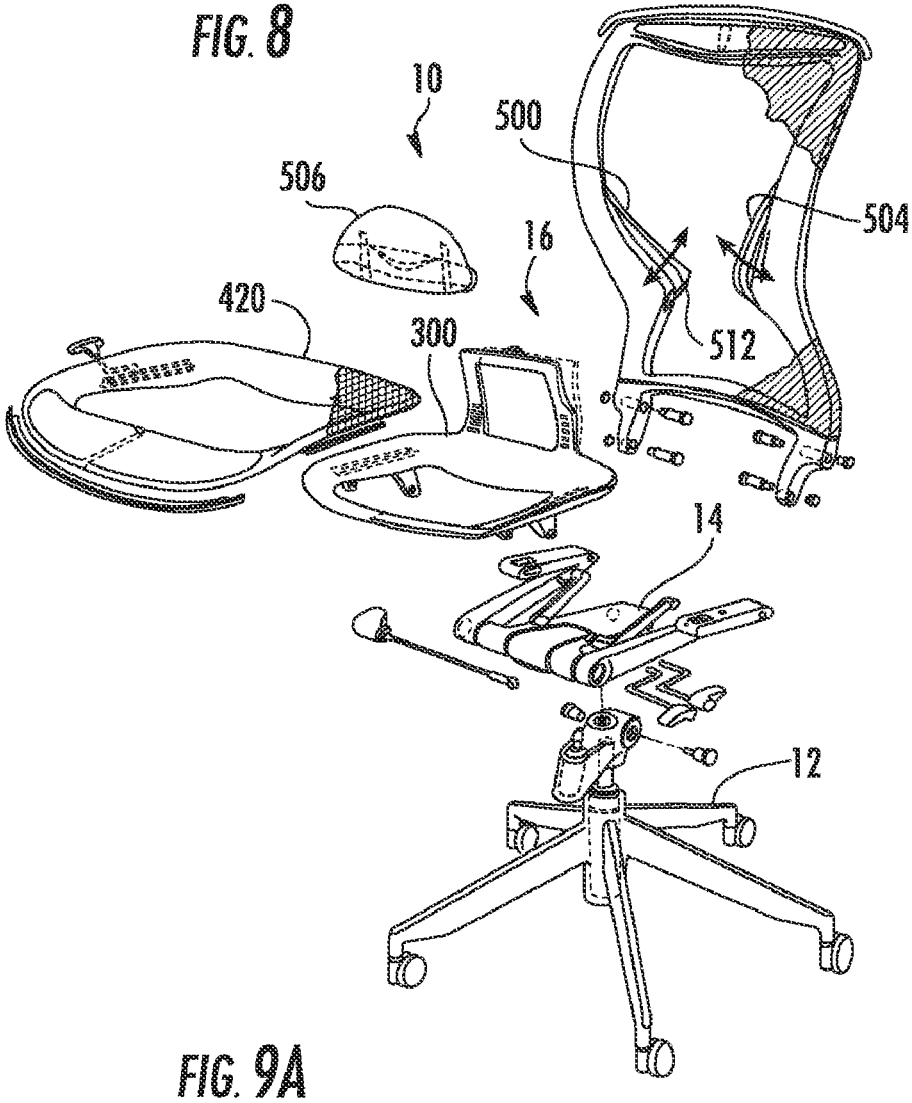
FIG. 9A is an exploded perspective view of a further task chair under the present invention.
Figure 9B:
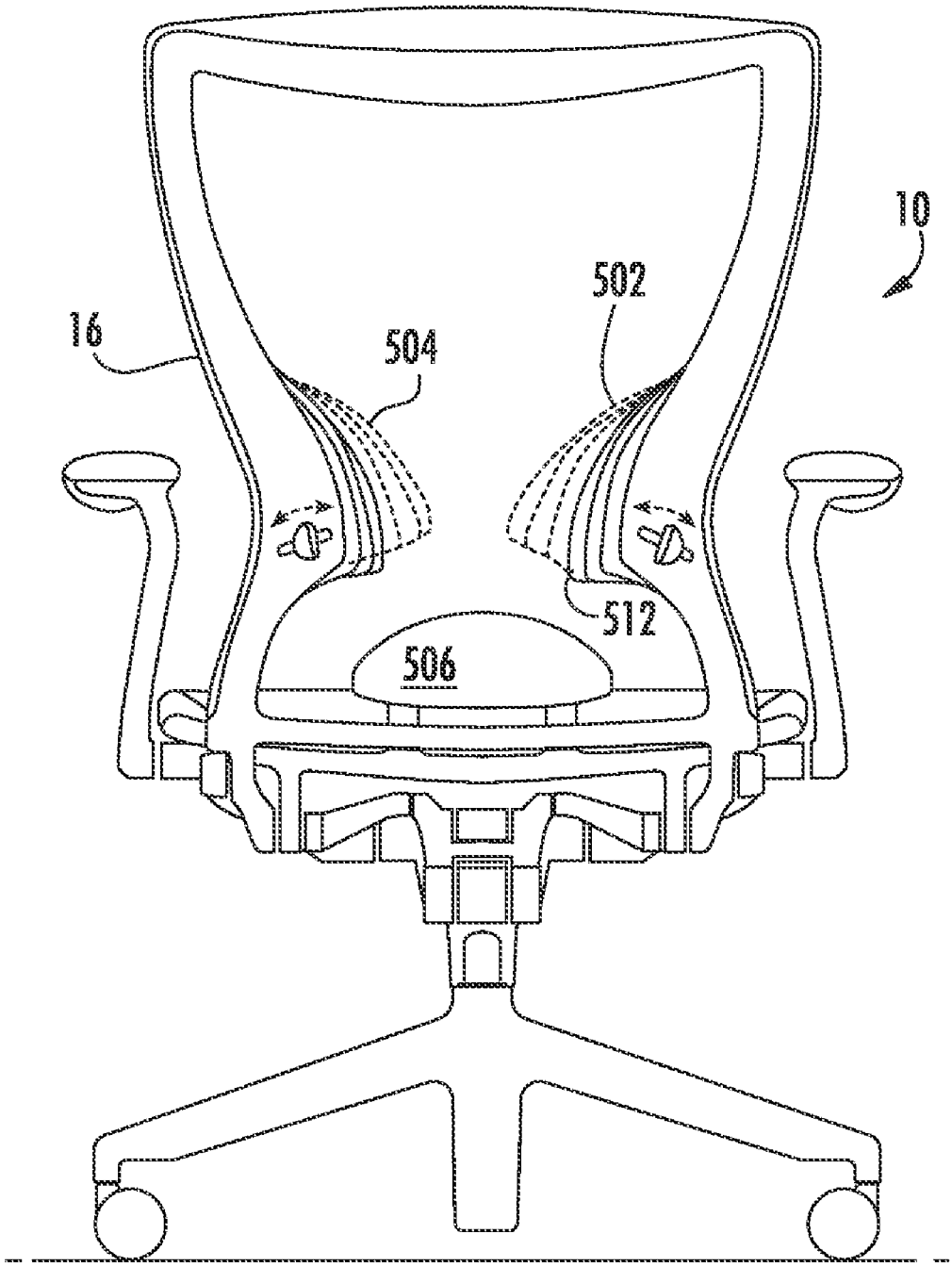
FIG. 9B is a view in rear elevation of the task chair of FIG. 9A in an assembled configuration.

FIGS. 9A and 9B disclose a further embodiment of the invention wherein dual supports 502 and 504 are provided along with a central lumbar support 506. In this embodiment, however, the dual lumbar supports 502 and 504 are each formed by one or more extendable and retractable support members 512. In FIG. 9A, for example, the dual lumbar supports 502 and 504 are formed by a plurality of fin-type support members 512 that are pivotable to varying degrees relative to the seat back. Under this arrangement, the support members 512 can be fanned out according to the preferences of the seat occupant to provide optimal back support. In certain embodiments, means can be provided for locking the support members 512 in desired configurations. Where a layer of flexible material, such as mesh, overlies the back frame, a selective disposition of the supports 502 and 504 can additionally induce a change in the deflective properties of the flexible material. Furthermore, each support member 512 can exhibit a degree of deflection thereby to flex under the application of force. As shown in FIG. 9B, for example, the lumbar supports 502 and 504 can be operable by slidable knobs 514 disposed in the seat and back assembly 16.

The embodiments of the task chair disclosed herein thus provide as kinematic, multi pivot point forward and backward tilting synchronized task chair mechanism. Certain embodiments, for example, can pivot from an 8 degree forward tilt to a 15 degree rearward tilt. The chair enables a multi-task work environment with mechanisms for supporting the seamless transition from work surface type tasks to reclined chair type tasks. Adjustment mechanisms incorporated into preferred embodiments of the chair enable comfortable support of very light and very heavy users thereby accommodating a wide demographic range of both males and females. The motion geometry creates a dynamic, interdependent relationship between the seat lumbar support and the seat back thereby improving the comfort and performance of the seat occupant. Still further, where resilient material overlies the frameworks of the chair, deflection and tension properties can be readily calibrated for different, users, seat portions, and purposes.

With certain details and embodiments of the present invention for a task chair with dual tilting capabilities disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof.

I claim as deserving the protection of United States Letters Patent:

1. A task chair capable of forward and rearward synchronized movement, the task chair comprising:

a base assembly;

a linkage supported by the base assembly to pivot about an axis in relation to the base assembly;

a seat assembly pivotally retained relative to the linkage; and a back assembly pivotally retained relative to the linkage;

wherein the linkage comprises a bracket and a resiliently deflectable assembly retained relative to the bracket, wherein the resiliently deflectable assembly has a first end and a second end, and wherein the bracket has a force-bearing portion that engages the resiliently deflectable assembly of the linkage whereby the linkage and the seat and back assemblies pivotally retained relative to the linkage can pivot in relation to the base assembly;

wherein the force-bearing portion is slidable relative to the bracket and longitudinally between the first and second ends of the resiliently deflectable assembly to adjust the effective location of force applied to the resiliently deflectable assembly by the force-bearing portion; and wherein the resiliently deflectable assembly of the linkage comprises a leaf spring stack with a plurality of leaf springs of sequential lengths and wherein the force-bearing portion of the bracket is disposed to engage a longest leaf spring of the leaf spring stack wherein the leaf spring stack is disposed in a leaf spring housing with an elongated tail disposed to a side of the leaf spring stack adjacent a shortest leaf spring of the leaf spring stack, wherein the leaf spring stack is retained by the leaf spring housing at a proximal end of the leaf spring stack, wherein the leaf spring stack is free at a distal end of the leaf spring stack, and wherein the elongated tail has an interior wall that tapers from a proximal end adjacent to the proximal end of the leaf spring stack toward a distal end adjacent to the distal end of the leaf spring stack.

2. A task chair capable of forward and rearward synchronized movement, the task chair comprising:

a base assembly;

a linkage supported by the base assembly;

a seat assembly pivotally retained relative to the linkage;

a back assembly pivotally retained relative to the linkage;

wherein the linkage comprises a bracket; a first link pivotally coupled at a first axis relative to the bracket, pivotally coupled at a second pivot axis relative to the seat assembly, and pivotally coupled at a third pivot axis directly to a bottom portion of the back assembly; and a second link pivotally coupled at a first axis relative to the bracket and at a second axis directly to the bottom portion of the back assembly wherein the third pivot axis of the first link relative to the back assembly is above the second pivot axis of the second link relative to the back assembly and wherein the second link has only the first and second axes and no further pivot axes; and wherein the seat assembly is pivotally coupled directly to the back assembly at the second axis of the second link.

3. A task chair capable of forward and rearward synchronized movement, the task chair comprising:

a base assembly;

a linkage supported by the base assembly;

a seat assembly pivotally retained relative to the linkage;

a back assembly pivotally retained relative to the linkage;

wherein the linkage comprises a bracket; a first link pivotally coupled at a first axis relative to the bracket, pivotally coupled at a second pivot axis relative to the seat assembly, and pivotally coupled at a third pivot axis directly to a bottom portion of the back assembly; and a second link pivotally coupled at a first axis relative to the bracket and at a second axis directly to the bottom portion of the back assembly; and wherein the linkage is supported by the base assembly to pivot about an axis in relation to the base assembly, wherein the linkage further comprises a resiliently deflectable assembly retained relative to the bracket, wherein the bracket has a force-bearing portion that engages the resiliently deflectable assembly of the linkage whereby the linkage and the seat and back assemblies pivotally retained relative to the linkage can pivot in relation to the base assembly, and wherein the resiliently deflectable assembly of the linkage comprises a leaf spring stack with a first end and a second end.

4. The task chair of claim 3 wherein the leaf spring stack comprises a plurality of leaf springs of sequential lengths.

5. The task chair of claim 3 wherein the resiliently deflectable assembly has a first end and a second end and wherein the force-bearing portion is slidable longitudinally between the first and second ends of the resiliently deflectable assembly to adjust the effective location of force applied to the resiliently deflectable assembly by the force-bearing portion.

6. The task chair of claim 5 wherein the resiliently deflectable assembly of the linkage comprises a leaf spring stack with a plurality of leaf springs of sequential lengths and wherein the force-bearing portion of the bracket is disposed to engage a longest leaf spring of the leaf spring stack, wherein the leaf spring stack has a proximal end adjacent to an anterior portion of the bracket and a free body portion that projects anteriorly, wherein the longest leaf spring is disposed to a bottom of the leaf spring stack, and wherein the first axis of the first link is fixed to pivot with the proximal end of the leaf spring stack whereby the leaf spring stack provides resilient opposition to a pivoting of the first link.

7. The task chair of claim 3 further comprising a longitudinally extendable and retractable assembly disposed to operate between the base assembly and the linkage.

8. The task chair of claim 7 wherein the longitudinally extendable and retractable assembly is chosen from the group consisting of a piston and a compression spring arrangement.

9. The task chair of claim 3 wherein the second pivot axis of the first link relative to the seat assembly comprises a kinematic joint that enables a pivoting and sliding connection between the seat assembly and the first link.

10. A task chair capable of forward and rearward synchronized movement, the task chair comprising:

a base assembly;

a linkage supported by the base assembly;

a seat assembly pivotally retained relative to the linkage;

a back assembly pivotally retained relative to the linkage; and wherein the linkage comprises a bracket; a first link pivotally coupled at a first axis relative to the bracket, pivotally coupled at a second pivot axis relative to the seat assembly, and pivotally coupled at a third pivot axis directly to a bottom portion of the back assembly; and a second link pivotally coupled at a first axis relative to the bracket and at a second axis directly to the bottom portion of the back assembly wherein the second pivot axis of the first link relative to the seat assembly comprises a kinematic joint that enables a pivoting and sliding connection between the seat assembly and the first link wherein the kinematic joint comprises a connection between a ball and a socket in combination with a sliding connection of the socket with a housing.

11. A task chair capable of forward and rearward synchronized movement, the task chair comprising:

a base assembly;

a linkage supported by the base assembly;

a seat assembly pivotally retained relative to the linkage; and a back assembly pivotally retained relative to the linkage;

wherein the linkage is supported by the base assembly to pivot about an axis in relation to the base assembly and wherein the linkage comprises a bracket; a first link pivotally coupled at a first axis relative to the bracket, pivotally coupled at a second pivot axis relative to the seat assembly, and pivotally coupled at a third pivot axis directly to a bottom portion of the back assembly; a second link pivotally coupled at a first axis relative to the bracket and at a second axis directly to a bottom portion of the back assembly; and a resiliently deflectable assembly retained relative to the bracket wherein the bracket has a force-bearing portion that engages the resiliently deflectable assembly of the linkage whereby the linkage and the seat and back assemblies pivotally retained relative to the linkage can pivot in relation to the base assembly;

wherein the third pivot axis of the first link relative to the back assembly is above the second pivot axis of the second link relative to the back assembly and wherein the second link has only the first and second axes and no further pivot axes; and wherein the resiliently deflectable assembly has a first end and a second end and wherein the force-bearing portion is slidable longitudinally between the first and second ends of the resiliently deflectable assembly to adjust the effective location of force applied to the resiliently deflectable assembly by the force-bearing portion.

12. The task chair of claim 11 wherein the resiliently deflectable assembly of the linkage comprises a leaf spring stack with a plurality of leaf springs of sequential lengths, wherein the force-bearing portion of the bracket is disposed to engage a longest leaf spring of the leaf spring stack, wherein the leaf spring stack has a proximal end adjacent to an anterior portion of the bracket and a free body portion that projects anteriorly, wherein the longest leaf spring is disposed to a bottom of the leaf spring stack, and wherein the first axis of the first link is fixed to pivot with the proximal end of the leaf spring stack whereby the leaf spring stack provides resilient opposition to a pivoting of the first link.

* * * * *